US009353618B2

(12) United States Patent
Jung et al.

(10) Patent No.: US 9,353,618 B2
(45) Date of Patent: May 31, 2016

(54) APPARATUS AND METHODS FOR COOLING DOWNHOLE DEVICES

(71) Applicant: BAKER HUGHES INCORPORATED, Houston, TX (US)

(72) Inventors: Sebastian Jung, Lower Saxony (DE); Thomas Kruspe, Niedersachsen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 488 days.

(21) Appl. No.: 13/665,229

(22) Filed: Oct. 31, 2012

(65) Prior Publication Data

US 2014/0116071 A1 May 1, 2014

(51) Int. Cl.
*F25D 3/12* (2006.01)
*E21B 47/01* (2012.01)

(52) U.S. Cl.
CPC ..... *E21B 47/011* (2013.01)

(58) Field of Classification Search
CPC ..... E21B 47/011; E21B 36/00; E21B 49/08; E21B 47/06
USPC ..... 62/56; 166/250.01
See application file for complete search history.

(56) References Cited

U.S. PATENT DOCUMENTS

| | | | | |
|---|---|---|---|---|
| 2,604,230 A | | 7/1952 | Payne | |
| 2,970,452 A | | 2/1961 | Beckman et al. | |
| 3,112,845 A | | 12/1963 | Bryant | |
| 3,156,100 A | | 11/1964 | Haettinger et al. | |
| 3,981,418 A | | 9/1976 | Williamson et al. | |
| 4,172,538 A | | 10/1979 | Thelberg | |
| 4,232,983 A | | 11/1980 | Cook et al. | |
| 4,561,568 A | | 12/1985 | Hoffmeister et al. | |
| 5,265,677 A | * | 11/1993 | Schultz | E21B 47/011 166/302 |
| 5,515,694 A | | 5/1996 | Meloling et al. | |
| 5,771,967 A | * | 6/1998 | Hyman | 165/274 |
| 6,012,453 A | | 1/2000 | Tsals et al. | |

(Continued)

FOREIGN PATENT DOCUMENTS

JP 2002310539 A * 10/2002 ..... F25B 41/06

OTHER PUBLICATIONS

PCT International Search Report and Written Opinion; International Application No. PCT/US2013/066386; International Filing Date: Oct. 23, 2013; Date of Mailing: Feb. 12, 2014; pp. 1-15.

(Continued)

*Primary Examiner* — Emmanuel Duke
(74) *Attorney, Agent, or Firm* — Cantor Colburn LLP

(57) ABSTRACT

An apparatus for cooling a downhole device is provided that in one embodiment includes a refrigerant having a saturation vapor pressure and stored in a chamber, an outlet configured to allow the refrigerant to discharge from the chamber and vaporize to cool the downhole device, and a force application device configured to apply pressure on the refrigerant in the chamber to maintain the refrigerant in the chamber at or above the saturation vapor pressure of the refrigerant. In another aspect, a method of cooling a device is provided that in one embodiment includes providing a chamber containing a refrigerant therein, the refrigerant having a saturation vapor pressure, discharging the refrigerant from the chamber to cause the refrigerant to evaporate to cause a cooling effect proximate the device to be cooled, and maintaining the refrigerant at or above the saturation vapor pressure of the refrigerant.

18 Claims, 4 Drawing Sheets

(56) References Cited

U.S. PATENT DOCUMENTS

| | | | | |
|---|---|---|---|---|
| 6,234,352 | B1 | 5/2001 | Richard et al. | |
| 6,769,487 | B2 | 8/2004 | Hache | |
| 7,681,760 | B2 * | 3/2010 | Sadamoto et al. | 222/95 |
| 8,074,739 | B2 | 12/2011 | Sun et al. | |
| 2006/0101831 | A1 * | 5/2006 | Storm et al. | 62/3.7 |
| 2008/0223579 | A1 | 9/2008 | Goodwin | |
| 2009/0206111 | A1 | 8/2009 | Conrardy et al. | |
| 2011/0308791 | A1 * | 12/2011 | Overmeyer et al. | 166/250.01 |
| 2012/0048531 | A1 * | 3/2012 | Marzouk | E21B 36/001 166/57 |

OTHER PUBLICATIONS

Bladder Accumulator/Products & Suppliers on GlobalSpec; http://beta.globalspec.com/industrial-directory/bladder_accumulator, Sep. 10, 2012, pp. 1-5.

* cited by examiner

APPARATUS AND METHODS FOR COOLING DOWNHOLE DEVICES

BACKGROUND INFORMATION

1. Field of the Disclosure

This disclosure relates generally to devices for use in high temperature environments, including, but not limited to, refrigerant evaporation devices for conducting heat away from or to payloads.

2. Brief Description of the Related Art

Wellbores for the production of hydrocarbons (oil and gas) are drilled using drilling and evaluation devices and tools. Wireline tools are used to log such wells after drilling. Current drilling and logging tools include a variety of sophisticated sensors, electronic circuits and hydraulic components to perform complex drilling operations and to obtain a variety of measurements downhole to determine various parameters of the formation and to evaluate and monitor drilling and wireline operations. Severe downhole environmental conditions exist in deep wells, such as temperatures up to 300° C. and pressure above 10,000 psi. Some wells are drilled up to 10,000 meters. Such downhole conditions make high demands on the materials and electronics used for drilling, making measurement-while-drilling (MWD) and wireline tool measurements. Thermoelectric coolers, based on the Peltier effect, and other types of devices, such as flasks have been used to maintain the temperatures of certain components about 50° C. below the ambient temperature of 200° C. However, fluid evaporation has generally not not been provided with external cooling during downhole operations.

The disclosure provides apparatus and methods for cooling components of downhole tools utilizing evaporation of a refrigerant downhole.

SUMMARY

In one aspect, the present disclosure provides an apparatus for cooling a downhole device that in one embodiment may include a storage chamber configured to store a refrigerant having a saturation vapor pressure, an outlet configured to allow the refrigerant to discharge from the chamber and vaporize to cool the downhole device and a force application device configured to apply pressure on the refrigerant in to maintain the refrigerant in the storage chamber at or above the saturation vapor pressure of the refrigerant. The saturation vapor pressure being the pressure at which the fluid remains in the liquid phase.

In another aspect, the present disclosure provides a method of cooling a device that in one embodiment may include: providing a storage chamber containing a refrigerant therein, the refrigerant having a saturation vapor pressure; discharging the refrigerant from the storage chamber to cause the refrigerant to evaporate to cool the device, and maintaining the refrigerant in the storage chamber at or above the saturation vapor pressure of the refrigerant.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF EXEMPLARY EMBODIMENTS

In general, the disclosure herein relates to a cooling systems for downhole and other applications that make use of a phase transition from liquid (or liquid phase) to a gas (or gaseous phase). In such a system, a liquid refrigerant evaporates proximate selected tools or components, thereby cooling such tools or components. The vaporous refrigerant in these cooling systems may be stored in suitable container, such as a pressure vessel, and the vapors used for cooling may be recycled or stored by a sorption process, vapor compression process or any other suitable process. The liquid refrigerant, which can attain both the liquid and gaseous phases in the storage container, is kept in the liquid phase, which allows extracting the refrigerant from the storage container proximate to the components in the liquid phase. In aspects, this is accomplished by adjusting the storage container volume to the volume of the stored refrigerant and maintaining the refrigerant at a pressure that is above the saturation vapor pressure of the refrigerant. A force or pressure application device or mechanism may be utilized to maintain the refrigerant in the liquid phase. In aspects, certain embodiments of the disclosed system may be operated independent of the orientation of the downhole tool in the wellbore.

Figure 1:
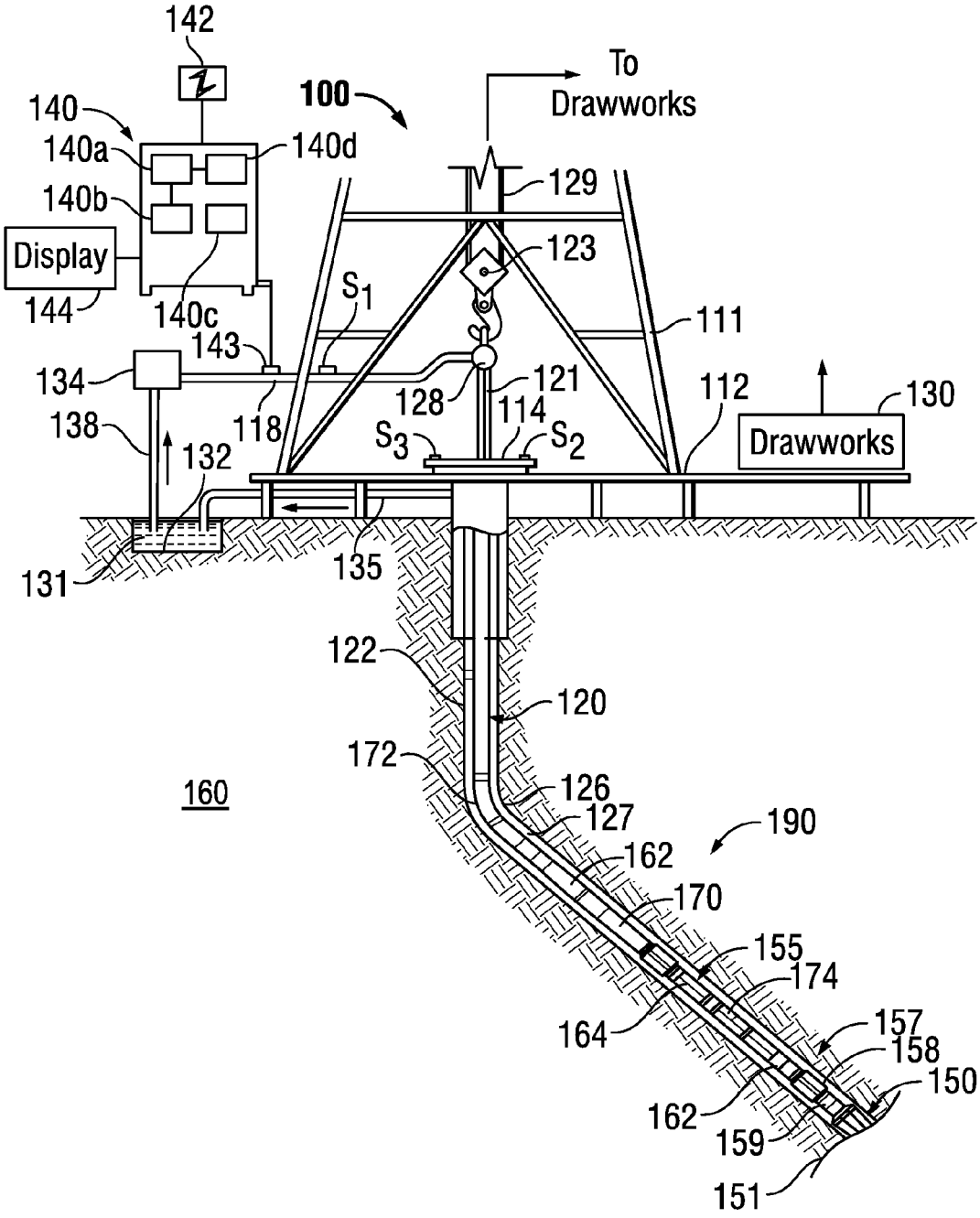
FIG. 1 shows a drilling system that includes a downhole tool that includes a cooling system made according to one embodiment of the disclosure for cooling components of the tool during a downhole operation.

FIG. 1 shows an exemplary drilling system that includes downhole tools that include a cooling system made according to one embodiment of the disclosure configured to cool components of such tools during downhole operations. FIG. 1 shows a schematic diagram of a drilling system 100 for drilling a wellbore 126 in an earth formation 160 and for estimating properties or characteristics of interest of the formation surrounding the wellbore 126 during the drilling of the wellbore 126. The drilling system 100 is shown to include a drill string 120 that comprises a drilling assembly or bottomhole assembly (BHA) 190 attached to a bottom end of a drilling tubular (drill pipe) 122. The drilling system 100 is further shown to include a conventional derrick 111 erected on a floor 112 that supports a rotary table 114 that is rotated by a prime mover, such as an electric motor (not shown), to rotate the drilling tubular 122 at a desired rotational speed. The drilling tubular 122 is typically made up of jointed metallic pipe sections and extends downward from the rotary table 114 into the wellbore 126. A drill bit 150 attached to the end of the BHA 190 disintegrates the geological formations when it is rotated to drill the wellbore 126. The drill string 120 is coupled to a drawworks 130 via a Kelly joint 121, swivel 128 and line 129 through a pulley 123. During the drilling of the wellbore 126 draw works 130 controls the weight on bit (WOB) which affects the rate of penetration.

During drilling operations, a suitable drilling fluid or mud 131 from a source or mud pit 132 is circulated under pressure through the drill string 120 by a mud pump 134. The drilling fluid 131 passes from the mud pump 134 into the drilling tubular 122 via a desurger (not shown) and a fluid line 118. The drilling fluid 131 discharges at the wellbore bottom 151 through an opening in the drill bit 150. The drilling fluid 131 circulates uphole through an annular space 127 between the drill string 120 and the wellbore 126 and returns to the mud pit 132 via return line 135. A sensor $S_1$ in the line 138 provides information about the fluid flow rate. A surface torque sensor $S_2$ and a sensor $S_3$ associated with the drill string 120 respectively provide information about the torque and the rotational speed of the drill string. Additionally, one or more sensors (collectively referred to as $S_4$) associated with line 129 are typically used to provide information about the hook load of the drill string 120 and other desired drilling parameters relating to drilling of the wellbore 126.

In some applications the drill bit 150 is rotated by rotating only the drilling tubular 122. However, in other applications a drilling motor (also referred to as the "mud motor") 155 disposed in the drilling assembly 190 is used to rotate the drill bit 150 and/or to superimpose or supplement the rotational speed of the drilling tubular 122.

The system 100 may further include a surface control unit 140 configured to provide information relating to the drilling operations and for controlling certain desired drilling operations. In one aspect, the surface control unit 140 may be a computer-based system that includes one or more processors (such as microprocessors) 140*a*, one or more data storage devices (such as solid state-memory, hard drives, tape drives, etc.) 140*b*, display units and other interface circuitry 140*c*. Computer programs and models 140*d* for use by the processors 140*a* in the control unit 140 are stored in a suitable data storage device 140*b*, including, but not limited to: a solid-state memory, hard disc and tape. The surface control unit 140 may communicate data to a display 144 for viewing by an operator or user. The surface control unit 140 also may interact with one or more remote control units 142 via any suitable data communication link 141, such as the Ethernet and the Internet. In one aspect, signals from downhole sensors 162 and downhole devices 164 (described later) are received by the surface control unit 140 via a communication link, such as fluid, electrical conductors, fiber optic links, wireless links, etc. The surface control unit 140 processes the received data and signals according to programs and models 140*d* provided to the surface control unit and provides information about drilling parameters such as weight-on-bit (WOB), rotations per minute (RPM), fluid flow rate, hook load, etc. and formation parameters such as resistivity, acoustic properties, porosity, permeability, etc. The surface control unit 140 records such information. This information, alone or along with information from other sources, may be utilized by the control unit 140 and/or a drilling operator at the surface to control one or more aspects of the drilling system 100, including drilling the wellbore along a desired profile (also referred to as "geosteering").

Still referring to FIG. 1, BHA 190, in one aspect, may include a force application device 157 that may contain a plurality of independently-controlled force application members 158, each of which may configured to apply a desired amount of force on the wellbore wall to alter the drilling direction and/or to maintain the drilling of the wellbore 126 along a desired direction. A sensor 159 associated with each respective force application member 158 provides signals relating to the force applied by its associated member. The drilling assembly 190 also may include a variety of sensors, collectively designated herein by numeral 162, located at selected locations in the drilling assembly 190, that provide information about the various drilling assembly operating parameters, including, but not limited to: bending moment, stress, vibration, stick-slip, tilt, inclination and azimuth. Accelerometers, magnetometers and gyroscopic devices, collectively designated by numeral 174, may be utilized for determining inclination, azimuth and tool face position of the drilling assembly operating parameters, using programs and models provided to a downhole control unit 170. In another aspect, the sensor signals may be partially processed downhole by a downhole processor at the downhole control unit 170 and then sent to the surface controller 140 for further processing.

Still referring to FIG. 1, the drilling assembly 190 may further include any desired MWD (or LWD) tools, collectively referred to by numeral 164, for estimating various properties of the formation 160. Such tools may include resistivity tools, acoustic tools, nuclear magnetic resonance (NMR) tools, gamma ray tools, nuclear logging tools, formation testing tools and other desired tools. Each such tool may process signals and data according to programmed instructions and provide information about certain properties of the formation. The downhole processor at the downhole control unit 170 may be used to calculate a parameter of interest from measurements obtained from the various LWD tools 164 using the methods described herein.

Still referring to FIG. 1, the drilling assembly 190 further includes a telemetry unit 172 that establishes two-way data communication between the devices in the drilling assembly 190 and a surface device, such as the control unit 140. Any suitable telemetry system may be used for the purpose of this disclosure, including, but not limited to: mud pulse telemetry, acoustic telemetry, electromagnetic telemetry and wired-pipe telemetry. In one aspect, the wired-pipe telemetry may include drill pipes made of jointed tubulars in which electrical conductors or fiber optic cables are run along individual drill pipe sections and wherein communication along pipe sections may be established by any suitable method, including, but not limited to: mechanical couplings, fiber optic couplings, electromagnetic signals, acoustic signals, radio frequency signals, or another wireless communication method. In another aspect, the wired-pipe telemetry may include coiled tubing in which electrical or fiber optic fibers are run along the length of coiled tubing. The drilling systems, apparatus and methods described herein are equally applicable to offshore drilling systems. Many of the tools and components of the BHA include hydraulic lines, such as lines supplying fluid to the steering devices, devices using pumps for obtaining fluid samples Also, the devices in the BHA include a large number of sensors and electronic components that operate more efficiently at lower temperatures and thus cooling such components downhole can improve their performance and extend their operating lives. The cooling devices and system described herein may be utilized to cool components downhole. Although FIG. 1 shows a drilling system, the cooling devices disclosed herein may be utilized for other downhole tools, including, but not limited to, wireline tools including resistivity tools, acoustic tools, magnetic resonance tools, nuclear tools and formation testing tools.

Figure 2:
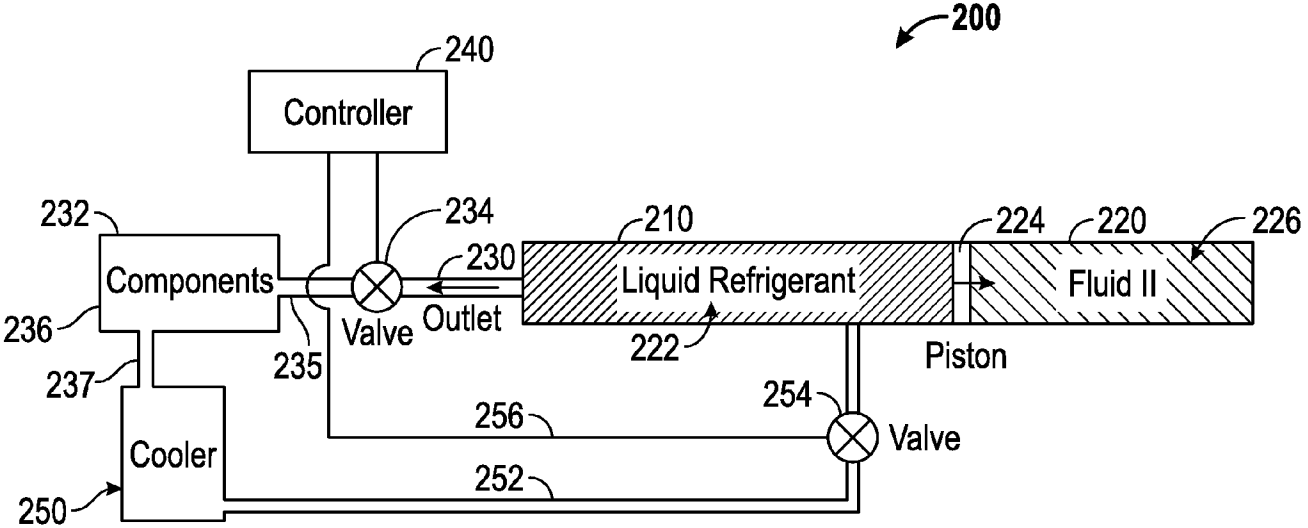
FIG. 2 shows an exemplary cooling apparatus that includes a device for supplying a refrigerant to components or devices to be cooled, wherein the refrigerant is stored in a storage chamber and a force fluid in another chamber that applies pressure or force on the refrigerant via a piston.

FIG. 2 shows an exemplary embodiment of a cooling system or unit 200 that may be incorporated in a tool whose components are desired to be cooled, such as the drilling assembly 190 shown in FIG. 1. The cooling system 200 includes a fluid container or storage container or tank 210 having that contains a refrigerant 222 and includes a secondary chamber 220 configured to apply pressure or force on the liquid refrigerant 222. In the particular embodiment shown, the storage container 210 and chamber 220 are separated by a movable member 224, such as a piston or a membrane. The movable member 224 may move freely in the storage container 210 and may seal chambers 210 and 220 from fluid communication with each other and may be made from any suitable material appropriate for the environment of the tool 190, including metallic, non-metallic and composite materials. In one aspect, the chamber 210 contains a suitable refrigerant 222 that evaporates when discharged from the chamber 210 via an outlet 230 and causes a cooling effect due to evaporation. The chamber 220 contains a secondary fluid 226 configured to apply a selected pressure or force on the refrigerant as the refrigerant is discharged from chamber 210. The fluid 226 exerts pressure on the piston 224, which in turn exerts pressure on the refrigerant 222. The fluid 226 is selected to have certain characteristics so that when it expands, it will exert a pressure sufficient to maintain the pressure on the refrigerant 222 above its saturation vapor pressure. In this configuration, the refrigerant 222 remains in a liquid state while in the storage chamber 210. When the refrigerant 222 is discharged from chamber 210, a portion of the fluid 226 evaporates or attains a gaseous state and causes the piston 224 to move to apply pressure on the refrigerant 222 to maintain it at or above its saturation vapor pressure. Thus, the refrigerant 222 remains in a liquid state while in the storage container 210. In an aspect, the piston 224 and chamber 220 filled with secondary fluid 222 is referred to as a force application device.

Still referring to FIG. 2, the system 200 may include a flow control device 234, such as a valve, controlled by a controller 240. The controller 240 may include a processor, such as a microprocessor, a memory device and programmed instructions relating to the operation of the flow control device 234. The opening and closing of the flow control device 234 by the controller 240 defines the amount of the refrigerant 222 discharged from the chamber 210. In one aspect, the refrigerant 222 may be discharged onto or proximate to components 232 to be cooled. In one aspect, the components 232 may be enclosed in a enclosure 236 having an inlet 235 and outlet 237. The liquid refrigerant 222 discharged in or proximate the components 232, thereby evaporating and cooling the components 232. In one aspect, the vaporized refrigerant may be discharged from the enclosure 236 into the wellbore or into the environment (not shown). In another aspect, the vaporized refrigerant may be discharged from the outlet 237 into a device 250. In one embodiment, the device 250 may be configured to store the evaporated refrigerant. In other embodiments, the device 250 may be a sorption cooler that stores the refrigerant in a sorption material or it may be or it may be a vapor compression device that converts the refrigerant vapors into liquid. In one configuration, the liquid from the device 250 may be fed back into the storage container 220 via a return line 252 and a control valve 254. The control valve 254 may also be controlled by the controller 240 via line 256.

Still referring to FIG. 2, in aspects, any suitable fluid may be selected as the refrigerant, including water. The secondary fluid 226 may be selected based on the saturation vapor pressure of the refrigerant 222. The saturation vapor pressure of the fluid 226 is at least slightly greater than the vapor saturation pressure of the refrigerant 222 over the desired operating range of the refrigerant 222 in the tool 190. If water is selected as the refrigerant, the typical operating temperature range is 150 degrees Celsius to 250 degrees Celsius. In this temperature range, propanol, having a vapor saturation pressure about two (2) bars higher than the vapor saturation pressure of water, may be utilized as the secondary fluid. Any other suitable combination of the refrigerant and the secondary fluid may be utilized in the cooling systems made according to one or more embodiments of this disclosure.

Figure 3:
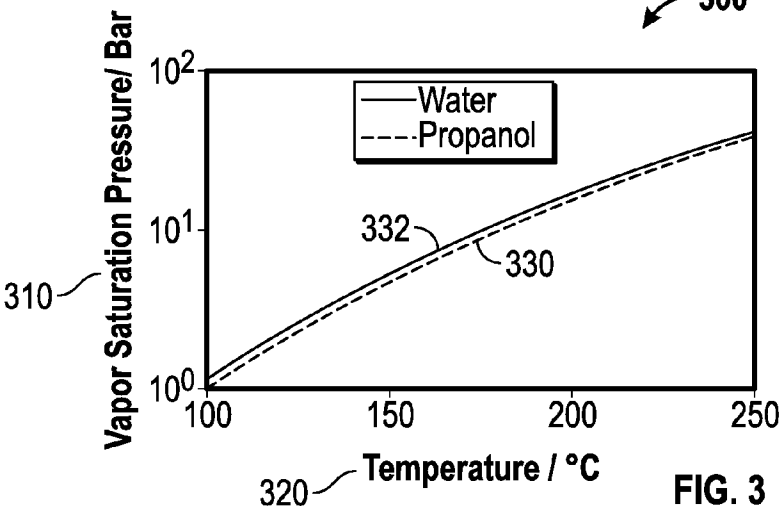
FIG. 3 shows an exemplary relationship of the saturation vapor pressure over temperature for the refrigerant and a force fluid for use in the cooling systems disclosed herein.

FIG. 3 shows an exemplary relationship 300 of vapor saturation pressure of water (refrigerant) and propanol (secondary fluid). The vapor saturation pressure 300 is shown along the vertical axis and the temperature 320 along the horizontal direction. Curve 330 represents the vapor saturation pressure for water and curve 332 for propanol. The vapor saturation pressure of propanol 332 is about two (2) bars higher than that of water 330.

Figure 4:
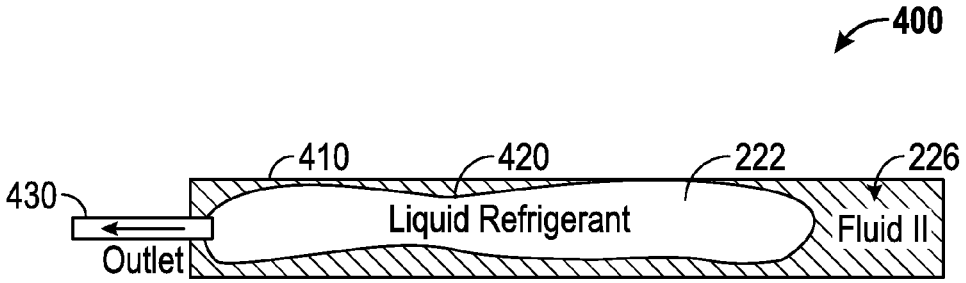
FIG. 4 shows an alternative device for supplying a refrigerant, wherein the refrigerant is stored in a collapsible container in a chamber surrounded by a force fluid.

FIG. 4 shows an alternative storage chamber 400, wherein the refrigerant 222 is stored in a collapsible container or tubular member 410. In one configuration, the collapsible container 410 may be placed in another chamber 420 filled with a suitable secondary fluid 226, such as propanol. The refrigerant 222 may be discharged from the collapsible container 410 via an outlet 430 in any suitable manner, including the manner shown in FIG. 2. The collapsible container 410 may be made from any suitable material, including, but not limited to, a thin metallic material, an alloy and elastomeric sheet or any combination thereof. The collapsible container 410 may be impermeable and compressed due the pressure applied by the secondary fluid 226 thereon.

Figure 5:
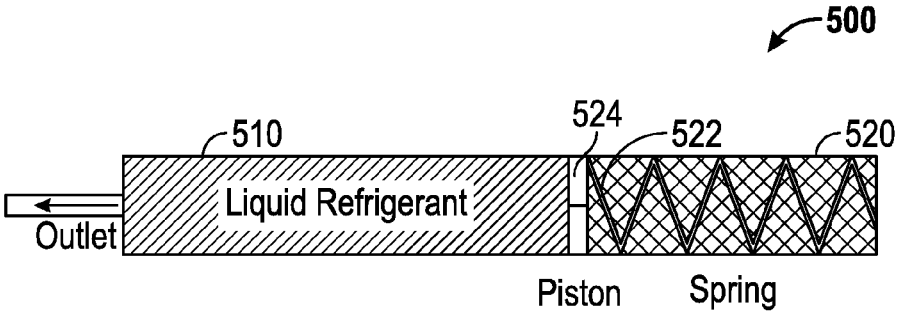
FIG. 5 shows yet another device for supplying a refrigerant, wherein pressure or force on the refrigerant is applied by a biasing device (mechanical, hydraulic or pneumatic) to maintain the refrigerant at or above the saturation vapor pressure of the refrigerant.

FIG. 5 shows yet another alternative storage chamber 500 that includes a chamber 510 for storing the refrigerant 222 substantially in the manner described in reference to FIG. 2 and a second chamber 520 that houses a force application device 522, such as a spring, configured to apply pressure on a movable member 524, such as a piston that in turn applies pressure on the refrigerant 222 and maintains the refrigerant at or above its saturation vapor pressure. Any other suitable force application device, such as a hydraulic pump supplying a fluid to chamber 520 or a pneumatic device providing a gas under pressure to chamber 520, may be utilized to apply pressure to the refrigerant 222 in chamber 510. The refrigerant may be discharged from chamber 510 via an outlet 530 in the manner described in reference to FIG. 2.

Figure 6:
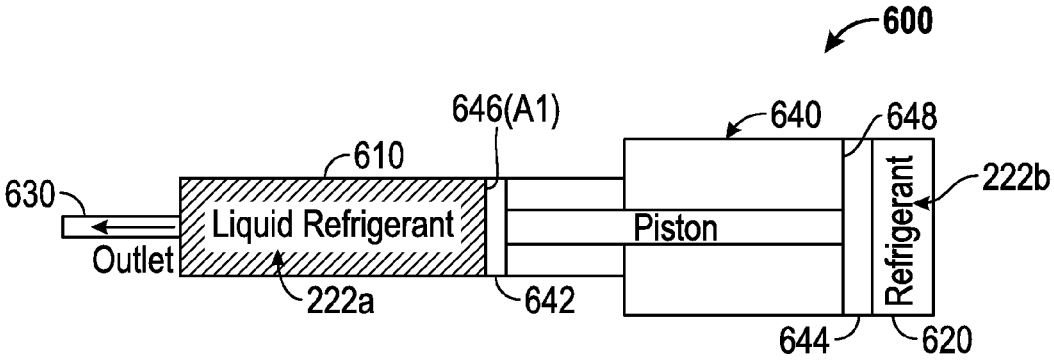
FIG. 6 shows yet another device for supplying a refrigerant, wherein the refrigerant is contained in a separate storage chambers and in pressure communication with a dual piston configured to maintain the refrigerant in one of the storage chambers at or above the saturation vapor pressure of the refrigerant in such storage chamber.

FIG. 6 shows yet another device 600 for supplying the refrigerant 222 via an outlet 630 to the devices to be cooled. The device 600 includes a first chamber 610 for storing a first amount or volume 222*a* of a refrigerant, such as refrigerant 222 described in FIG. 2, for cooling the desired components and a second chamber 620 for storing a second amount or volume 222*b* of the refrigerant 222 that acts as the force fluid. A dual piston 640 is in pressure communication with both refrigerant volumes 222*a* and 222*b*. A first (smaller) piston

642 of the dual piston 640 having a surface area 646 (area A1) acts on the refrigerant 222*a* in chamber 610. A second (larger) piston 644 of the dual piston 640 having a surface area 648 (area A2), wherein A2 is greater than A1, acts on the refrigerant 222*b* in chamber 620. When the refrigerant 222*a* is discharged from the chamber 610 via outlet 630, the refrigerant 222*b* in chamber 620 expands due to vaporizing of the refrigerant 222*b*. The areas A1 and A2 are selected such that they are exposed to the same fluid on both sides of the piston and cause a higher pressure to be exerted on the refrigerant 222*a* than on refrigerant 222*b* so as to maintain the refrigerant 222*a* in the liquid phase.

Figure 7:
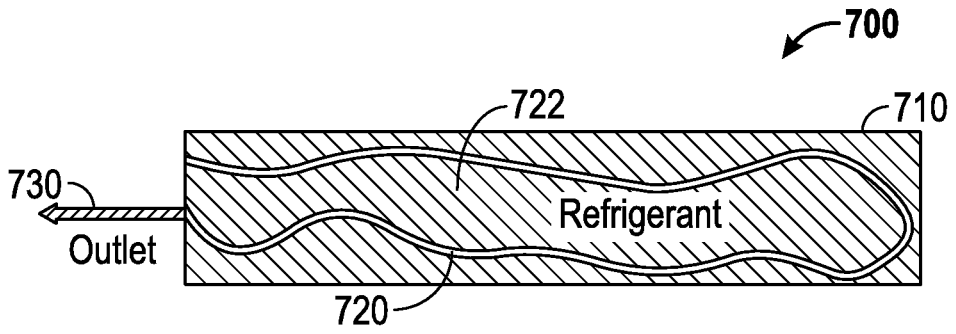
FIG. 7 shows yet another alternative embodiment of a storage device for supplying liquid refrigerant to the components to be cooled.

FIG. 7 shows yet another alternative embodiment of a storage device 700 for supplying liquid refrigerant to the components to be cooled. The device 700 includes a supply tank 710 that contains a fluid 722 in a liquid and vaporous phase. The supply tank 710 includes a wick 720 that is immersed in the refrigerant 622 and is connected to the outlet 730. The liquid phase is absorbed by capillary forces into the wick 720. These capillary forces then move the liquid refrigerant 622 to the outlet 730.

Figure 8:
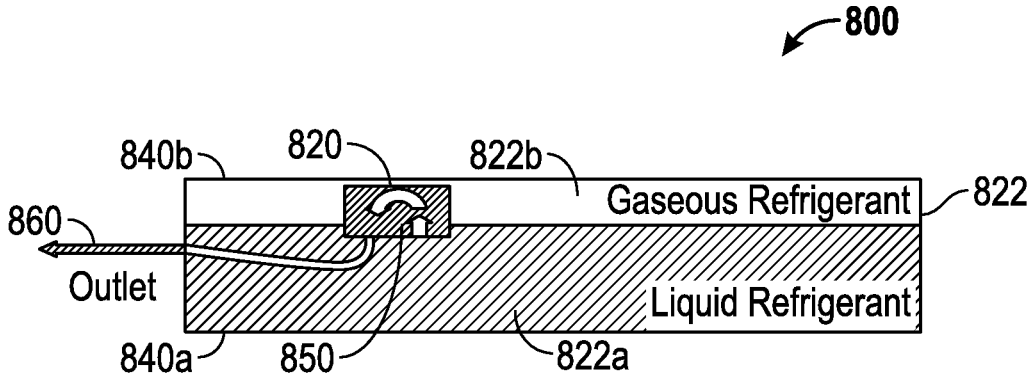
FIG. 8 shows yet another device for supplying a liquid refrigerant to the components to be cooled.

FIG. 8 shows yet another device 800 for supplying a liquid refrigerant to the components to be cooled. The device 800 includes supply chamber or tank 810 that contains a fluid 822 in the liquid phase 822*a* and vaporous phase 822*b* and a float assembly 820. Since the density of the liquid phase 822*a* is generally higher than the density of the gaseous phase 822*b*, gravity separates the two phase in two layers. The lower layer 840*a* contains the refrigerant in its liquid phase and the upper layer 844*b* in the gaseous phase. The float assembly 820 is configured to float on the liquid phase 844*a* and has its inlet 850 on its lower surface. The inlet 850 of the float assembly 820 is connected to the outlet 860 of the storage tank 810. Thereby only the liquid phase 840*a* of the refrigerant 822 is extracted at the outlet 860.

Figure 9:
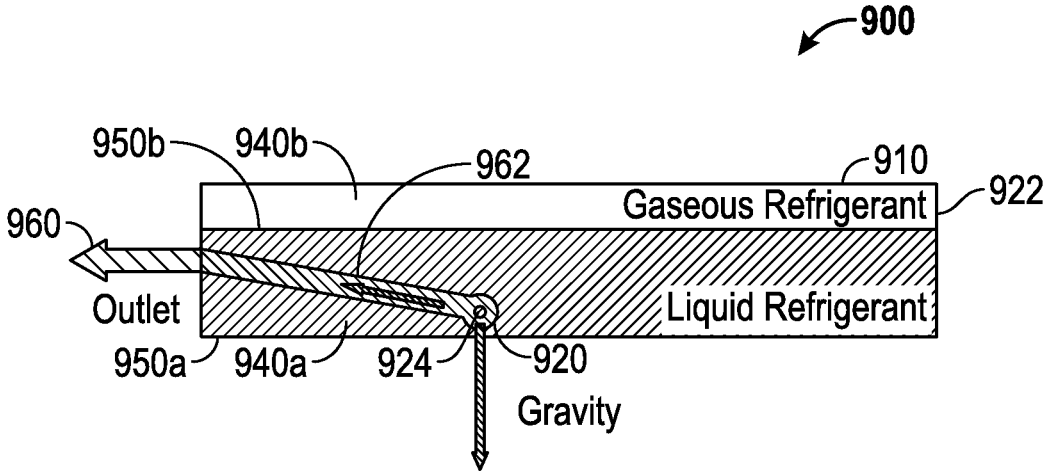
FIG. 9 shows yet another device for supplying a liquid refrigerant to the components to be cooled.

FIG. 9 shows yet another device 900 for supplying a liquid refrigerant to the components to be cooled. Device 900 includes a supply chamber or tank that contains a fluid 922 in its liquid phase 940*a* and vaporous phase 940*b*. The device 900 further includes a pendulum 920. Since the density of the liquid phase 940*a* is generally higher than the density of the gaseous phase 940*b*, gravity separates the two phase in two layers. The lower layer 950*a* contains the refrigerant in its liquid phase 940*a* and the upper layer 950*b* the gaseous phase 940*b*. The pendulum 920 lies on the bottom of the storage tank 910. The pendulum has an inlet 924 on its surface that is connected to the outlet 960 of the storage tank 910 by a flexible hose 962. In this configuration, only the liquid phase 940*a* of the refrigerant 922 is extracted at the outlet 960.

The foregoing description is directed to particular embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. An apparatus for cooling a downhole device, comprising:

a chamber configured to store a refrigerant having a saturation vapor pressure;

an outlet configured to allow the refrigerant to discharge from the chamber and vaporize to cool the downhole device;

a movable member stored within the chamber; and a force application device stored within the chamber configured to expand during discharge of the refrigerant to apply pressure on the movable member against the refrigerant in the chamber to maintain the refrigerant in the chamber at or above the saturation vapor pressure of the refrigerant.

2. The apparatus of claim 1, wherein the force application device includes:

a secondary fluid in a secondary chamber and the movable member is between the refrigerant and the secondary fluid and is in pressure communication between the refrigerant and the secondary fluid.

3. The apparatus of claim 2, wherein the refrigerant includes water and the secondary fluid includes a fluid that includes liquid and vapors.

4. The apparatus of claim 1, wherein the force application device substantially continuously applies pressure on the refrigerant as the refrigerant discharges from the chamber to maintain the pressure on the refrigerant at or above the saturation vapor pressure of the refrigerant.

5. The apparatus of claim 1, wherein the force application device comprises a biasing member configured to apply force on the movable member to apply pressure on the refrigerant in the chamber.

6. The apparatus of claim 1, wherein the force application device includes a secondary fluid within a secondary chamber and the movable member is a double piston in pressure communication with the refrigerant in the chamber and the secondary fluid in the secondary chamber, wherein the double piston is configured to maintain the pressure on the refrigerant in the chamber at or above the saturation pressure of the refrigerant in the chamber.

7. The apparatus of claim 6, wherein the fluid in the secondary chamber is refrigerant.

8. The apparatus of claim 1, wherein the movable member is a collapsible container that encloses the refrigerant and the force application device is a secondary fluid surrounding the collapsible container that attains a gaseous state when expanded.

9. The apparatus of claim 1 further comprising:

a valve; and a controller configured to control the valve to discharge the refrigerant from the outlet.

10. The apparatus of claim 1 further comprising a sorption device configured to store the refrigerant vapors in a liquid or solid material.

11. The apparatus of claim 1, wherein the device to be cooled is a component of a downhole tool belonging to group consisting of: (1) a drilling tool; (2) a logging-wile-drilling tool; and (3) a wireline tool.

12. An apparatus for cooling a downhole device, comprising: a chamber configured to store a refrigerant in a liquid phase and a gaseous phase; an outlet configured to allow the refrigerant to discharge from the chamber to the downhole device; and a device within the chamber configured to extract the liquid phase of the refrigerant from the chamber to the outlet and retain the gaseous phase in the chamber: wherein the device within the chamber includes a device selected from a group consisting of: a wick; a float device; and a pendulum.

13. A method of cooling a device, comprising:

providing a container;

providing a movable member in the container that separates the container into a first chamber and a secondary chamber, wherein the first chamber contains a refrigerant therein, the refrigerant having a saturation vapor pressure;

discharging the refrigerant from the first chamber to cause the refrigerant to evaporate to cause a cooling effect proximate the device to be cooled; and using a force application device stored within the secondary chamber to expand during discharge of the refrigerant to apply a pressure on the movable member against the refrigerant in the first chamber to maintain a pressure of the refrigerant in the first chamber at or above the saturation vapor pressure of the refrigerant.

14. The method of claim 13 further comprising capturing vapors of the refrigerant after the refrigerant has been discharged from the first chamber and performing an operation that is selected from a group consisting of: converting the captured vapors into the liquid refrigerant; and (2) storing the captured vapors.

15. The method of claim 13, wherein maintaining the pressure of the refrigerant in the first chamber at or above the saturation vapor pressure of the refrigerant comprises a process selected from a group consisting of: (1) applying the pressure on the refrigerant using a secondary fluid in the secondary chamber that evaporates when expanded; (2) applying the pressure using a biasing member in the secondary chamber; and (3) applying the pressure on the chamber containing the refrigerant using a secondary fluid in the secondary chamber.

16. The method of claim 13, wherein applying the pressure on the refrigerant is selected from a group of processes consisting of: (1) applying force using a secondary fluid in the secondary chamber that expands; (2) using a biasing member in the secondary chamber; (3) using a fluid of the secondary chamber surrounding at least a portion of the first chamber containing the refrigerant; (4) using an additional amount of the refrigerant contained in the secondary chamber to apply a force on a dual piston in pressure communication with the refrigerant in the first chamber and the additional amount of the refrigerant contained in the secondary chamber.

17. An apparatus for cooling a component of a downhole tool configured to obtain measurements relating to a parameter of interest in a wellbore, comprising:

a chamber configured to store a refrigerant having a saturation vapor pressure;

an outlet configured to allow the refrigerant to discharge from the chamber and vaporize to cool the downhole device;

a movable member stored within the chamber; and a force application device stored within the chamber configured to expand during discharge of the refrigerant to apply pressure on the movable member against the refrigerant in the chamber to maintain the refrigerant in the chamber at or above the saturation vapor pressure of the refrigerant.

18. The apparatus of claim 17, wherein the force application device is selected from a group consisting of: (1) a secondary fluid configured to apply pressure on the refrigerant via the movable member as the refrigerant is discharged from the chamber; (2) a biasing member configured to apply pressure on the refrigerant via the movable member; (3) a secondary fluid configured to apply pressure on the chamber as the refrigerant discharges from the chamber; (4) an additional amount of the refrigerant contained within a secondary chamber configured to apply a force on a dual piston device in pressure communication with the refrigerant and the additional amount of the refrigerant in the secondary chamber, wherein the pistons of the dual piston are sized to cause one of the pistons to apply pressure on the refrigerant to maintain the refrigerant in the chamber at or above the saturation pressure of the refrigerant in the chamber.

* * * * *